US006603266B1

(12) United States Patent
Schermerhorn

(10) Patent No.: US 6,603,266 B1
(45) Date of Patent: Aug. 5, 2003

(54) FLAT-PANEL DISPLAY

(75) Inventor: Jerry D. Schermerhorn, Perrysburg, OH (US)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/259,940

(22) Filed: Mar. 1, 1999

(51) Int. Cl.[7] ..... H01J 17/49
(52) U.S. Cl. ..... 313/587; 313/586; 313/584
(58) Field of Search ..... 313/582, 583, 313/584, 585, 586, 587, 498

(56) References Cited

U.S. PATENT DOCUMENTS

| | | | | |
|---|---|---|---|---|
| 3,499,167 A | | 3/1970 | Baker et al. | |
| 3,559,190 A | | 1/1971 | Bitzer et al. | |
| 3,755,027 A | | 8/1973 | Gilsing | |
| 3,801,851 A | * | 4/1974 | Andoh et al. | 313/586 |
| 3,942,061 A | | 3/1976 | van Esdonk et al. | |
| 4,198,585 A | | 4/1980 | Yamashita et al. | |
| 4,494,038 A | | 1/1985 | Wedding et al. | |
| 4,629,942 A | | 12/1986 | Horio et al. | |
| 4,638,218 A | | 1/1987 | Shinoda et al. | |
| 4,723,093 A | | 2/1988 | Nolan | |
| 4,737,687 A | | 4/1988 | Shinoda et al. | |
| 5,086,297 A | | 2/1992 | Miyake et al. | |
| 5,124,615 A | * | 6/1992 | Kim | 313/485 |
| 5,144,200 A | | 9/1992 | Kim | |
| 5,164,633 A | | 11/1992 | Kim et al. | |
| 5,525,862 A | | 6/1996 | Miyazaki | |
| 5,541,479 A | | 7/1996 | Nagakubo | |
| 5,634,836 A | | 6/1997 | Lepselter | |
| 5,661,500 A | | 8/1997 | Shinoda et al. | |
| 5,674,553 A | | 10/1997 | Shinoda et al. | |
| 5,723,945 A | | 3/1998 | Schermerhorn | |
| 5,747,939 A | * | 5/1998 | Kim et al. | 315/169.4 |
| 5,757,131 A | * | 5/1998 | Tsuchiya | 375/582 |
| 6,051,928 A | * | 4/2000 | Choi et al. | 313/582 |
| 6,380,678 B1 | * | 4/2002 | Kim | 313/586 |

FOREIGN PATENT DOCUMENTS

| | | | |
|---|---|---|---|
| JP | 57103234 | * 12/1980 | H01J/11/02 |
| JP | 55179962 | 6/1982 | |
| JP | 57103234 A | * 6/1982 | H01J/11/02 |
| JP | 58153545 | 8/1983 | |
| JP | 10-333636 | 12/1998 | |
| JP | 10038688 | 8/1999 | |
| JP | 11238462 | * 8/1999 | H01J/11/02 |
| JP | 10069949 | 10/1999 | |

* cited by examiner

*Primary Examiner*—Ashok Patel
*Assistant Examiner*—Karabi Guharay
(74) *Attorney, Agent, or Firm*—MacMillan, Sobanski & Todd, LLC

(57) ABSTRACT

Isolated conductive Charge Storage Pads (CSP's) are incorporated in and strategically positioned to increase the efficiency of a flat panel gas discharge plasma display device. The display comprises a hermetically sealed gas filled enclosure which includes a first glass substrate having a plurality of electrodes covered by a thin dielectric film upon which charge storage pads are placed, and a second glass substrate spaced from the first glass substrate. The second substrate includes a plurality of phosphor coated microvoids filled with an ionizable gas, each associated with an address electrode.

48 Claims, 6 Drawing Sheets

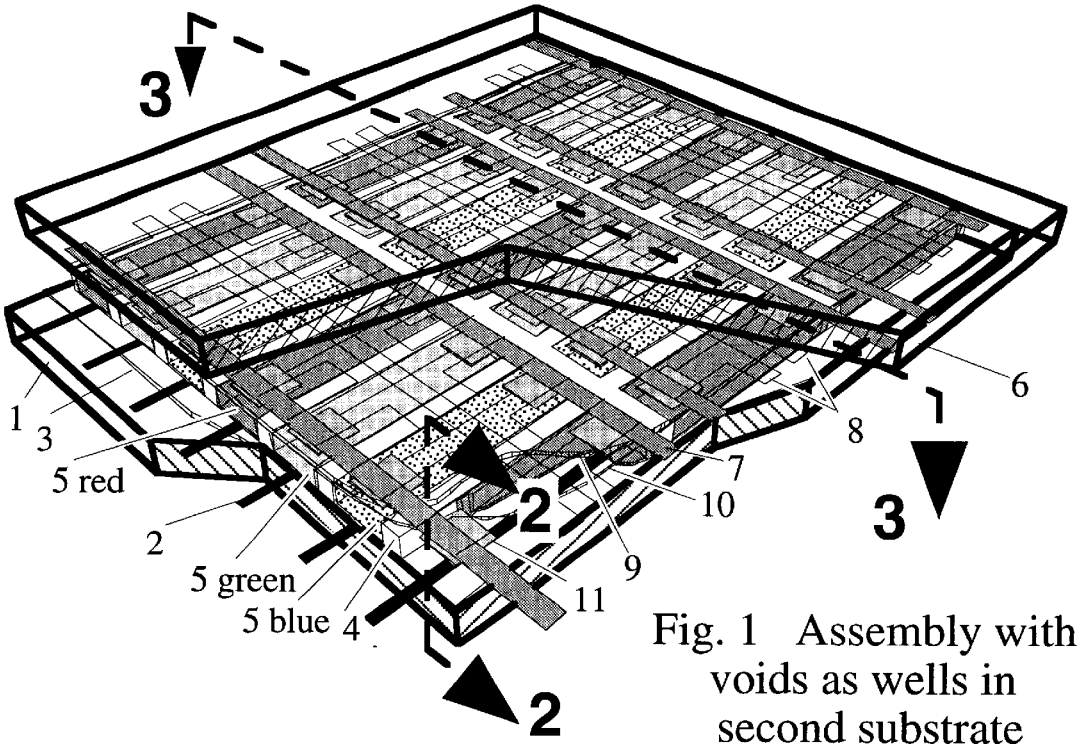
Fig. 1 Assembly with voids as wells in second substrate
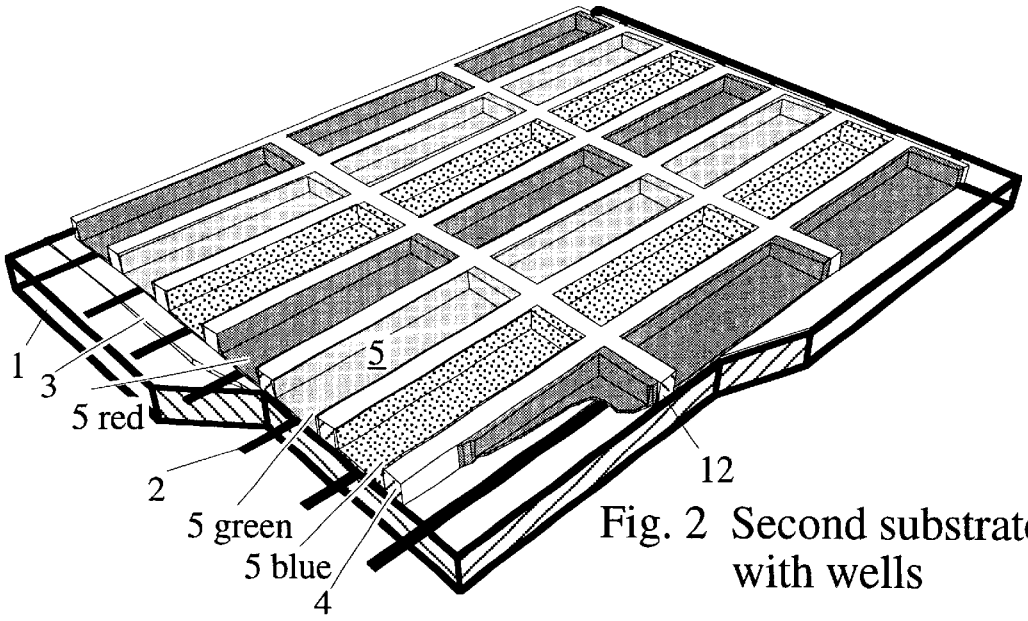
Fig. 2 Second substrate with wells

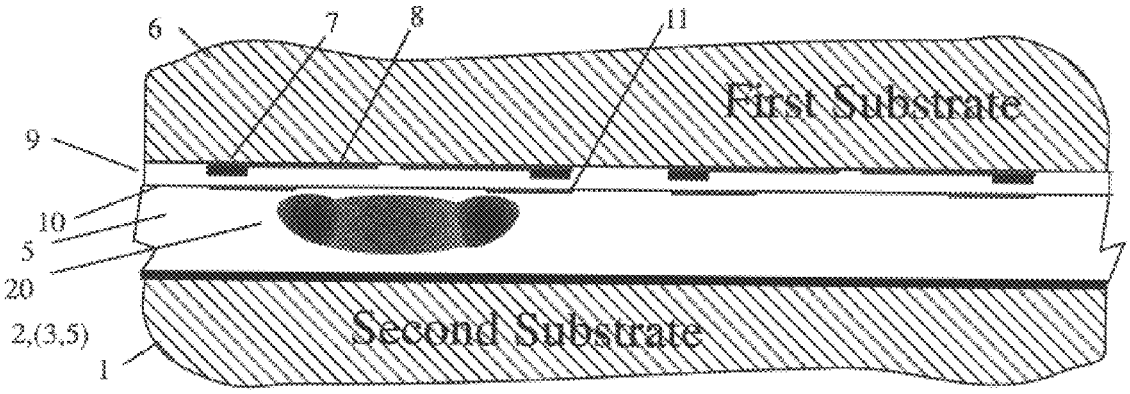
Figure 3 Sustainer Electrode Arrangement with Charge Storage Pads
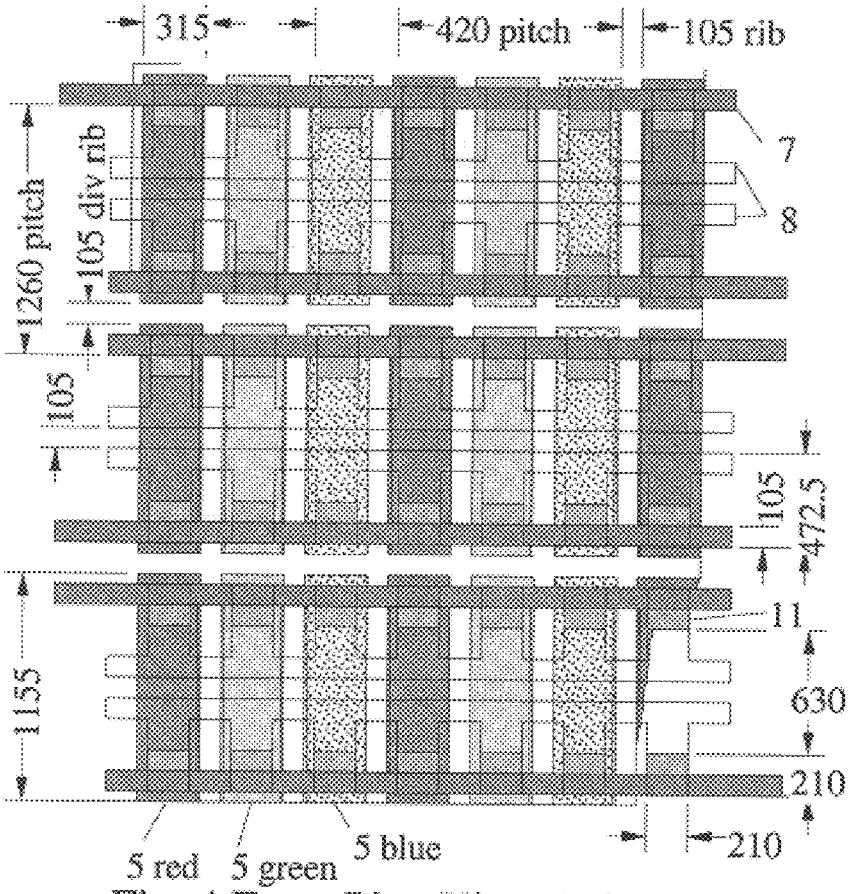
Fig. 4 Front Plan View (microns)

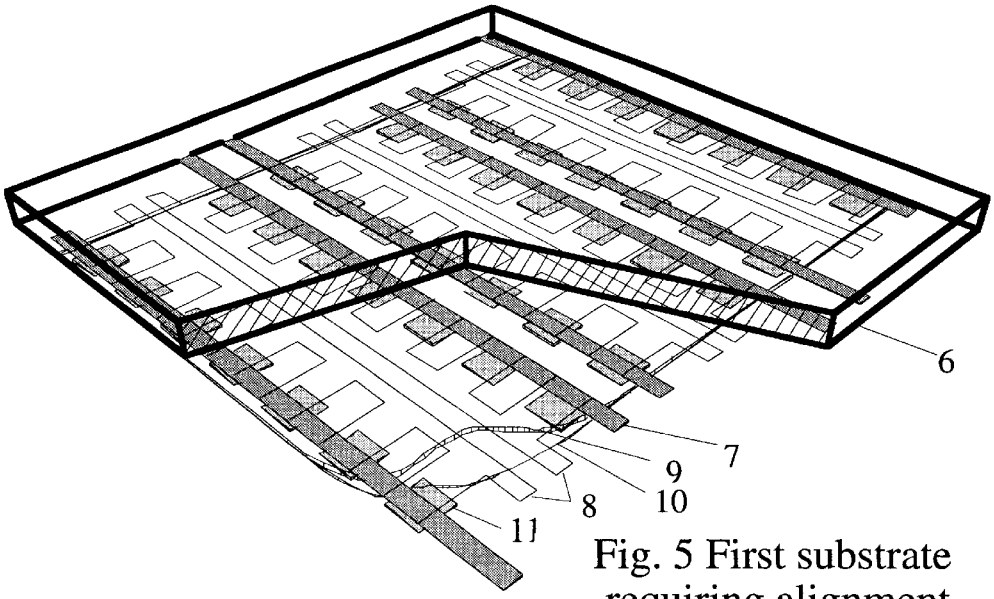
Fig. 5 First substrate requiring alignment
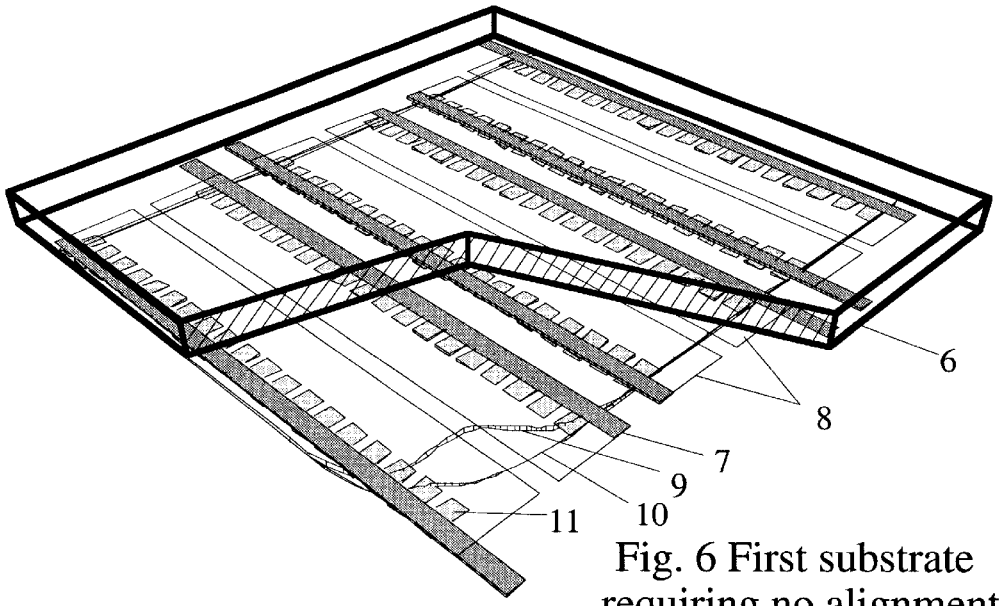
Fig. 6 First substrate requiring no alignment

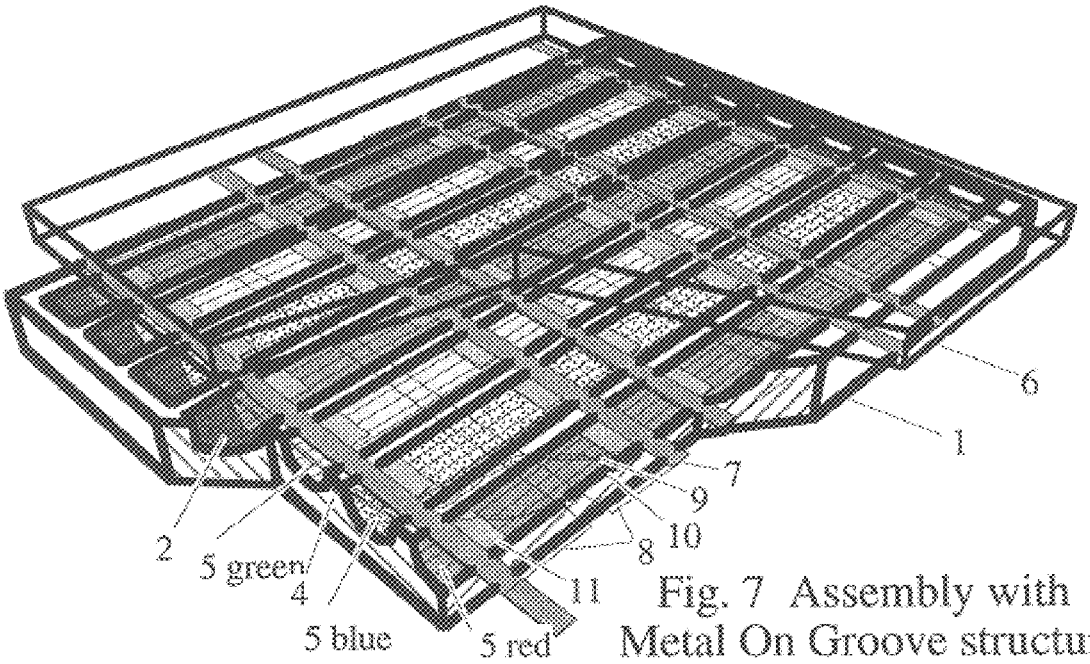
Fig. 7 Assembly with Metal On Groove structure
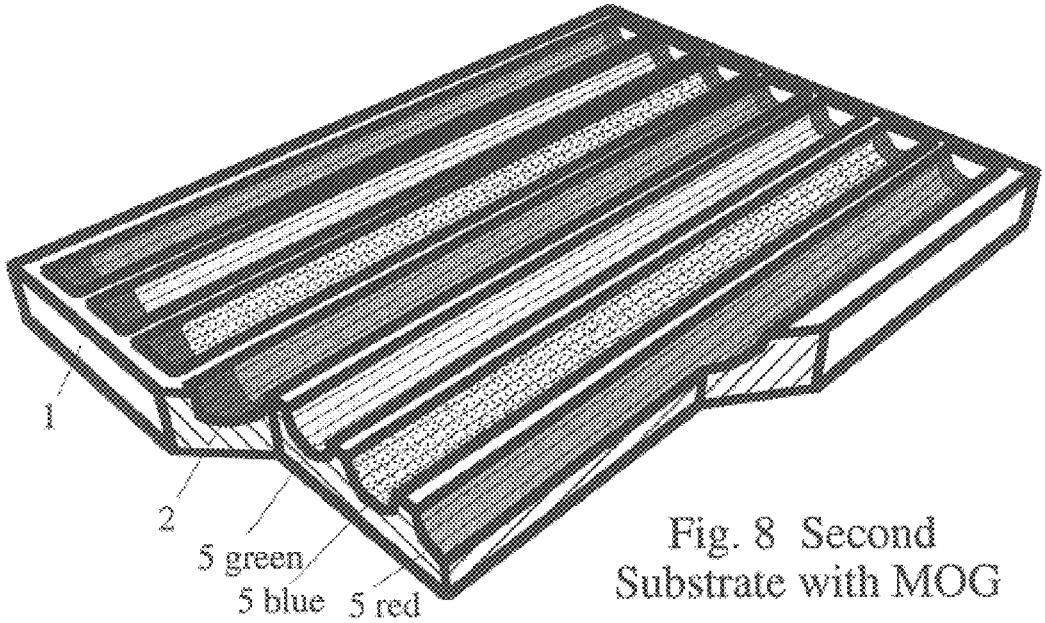
Fig. 8 Second Substrate with MOG

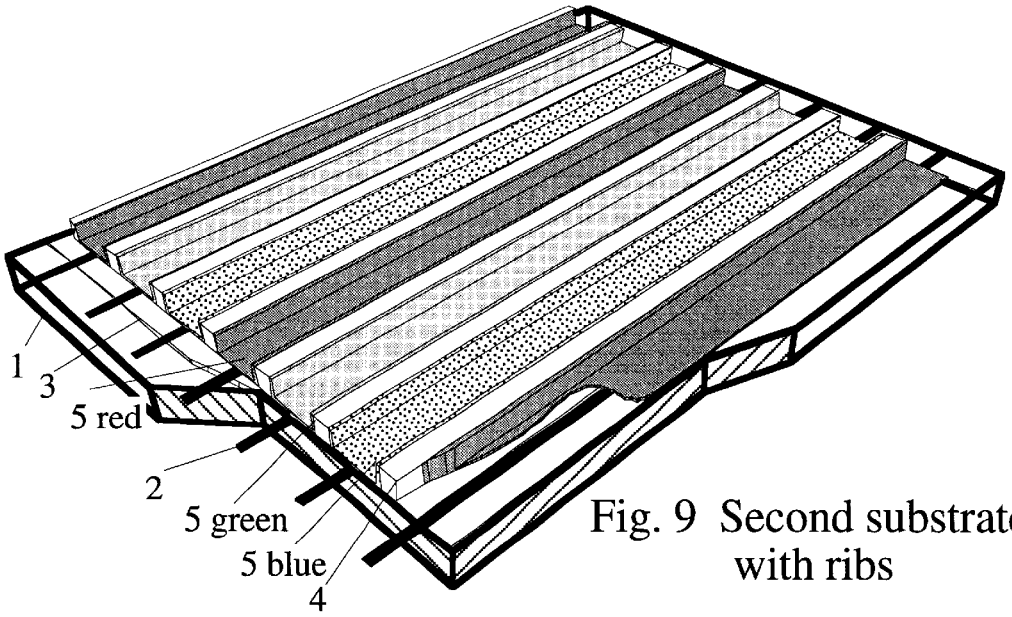
Fig. 9 Second substrate with ribs
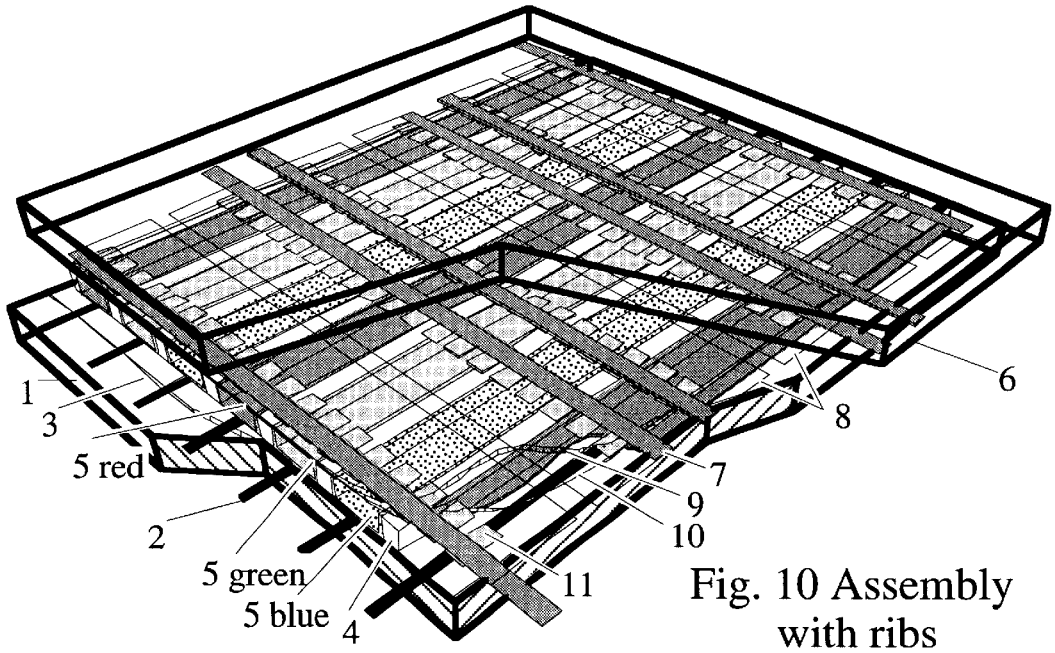
Fig. 10 Assembly with ribs

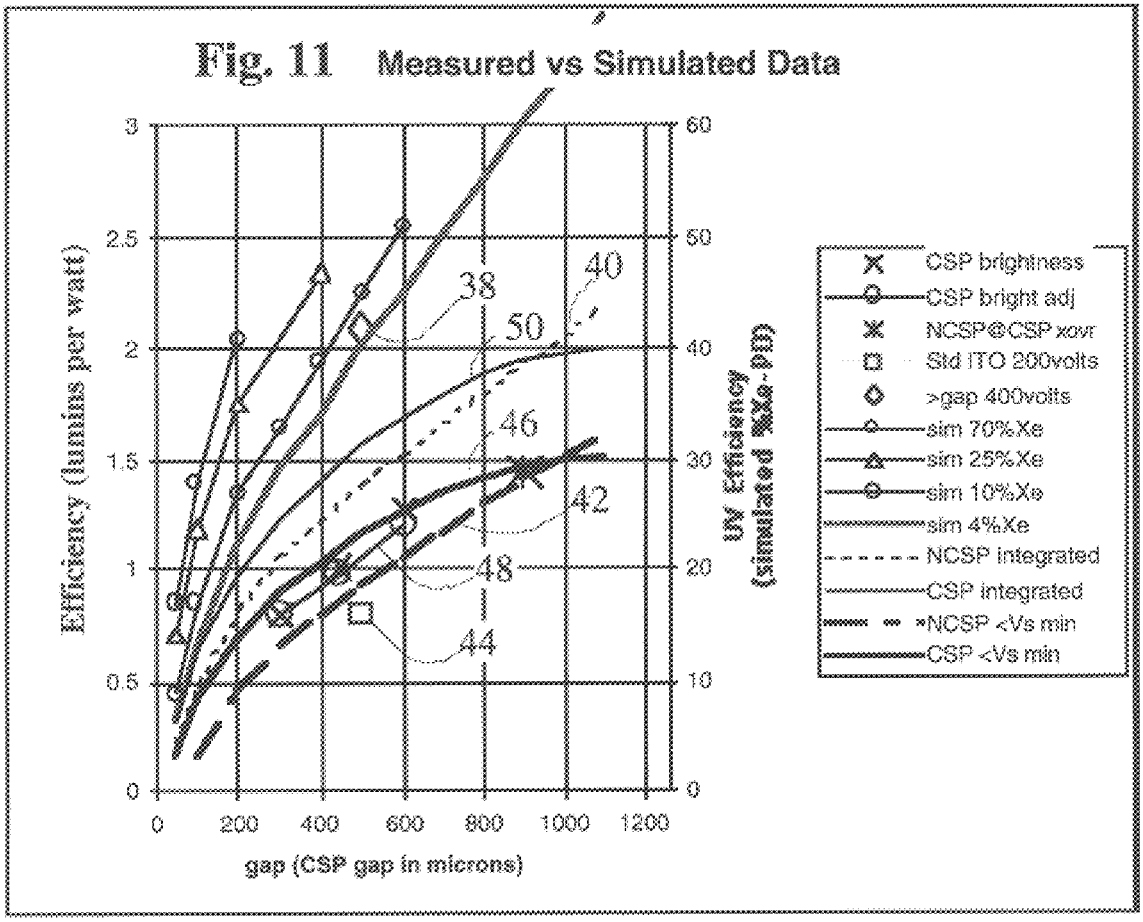
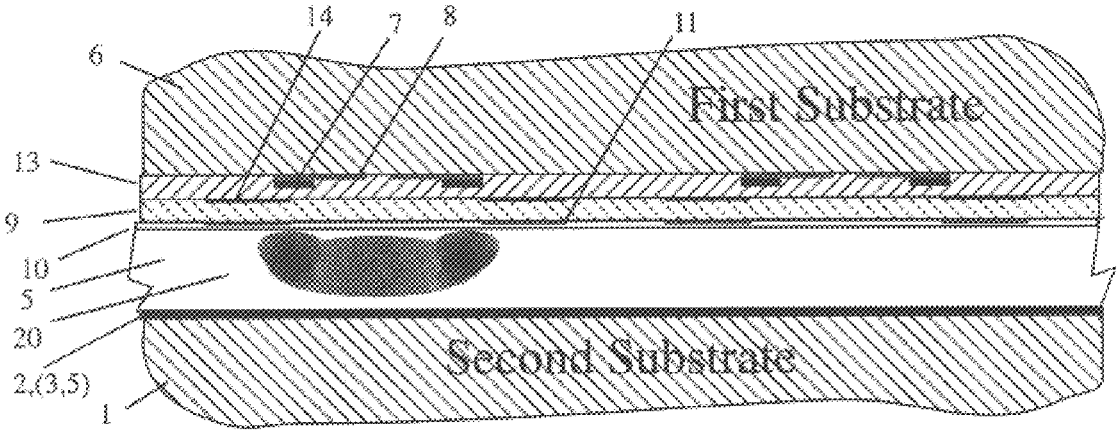
Fig.12 Cross-section showing alternate embodiment

FLAT-PANEL DISPLAY

FIELD OF INVENTION

This invention relates in general to a flat-panel display and in particular to an improved structure for a full color, high resolution capable flat-panel display which operates at a high efficiency.

BACKGROUND OF THE INVENTION

A flat-panel display is an electronic display in which a large orthogonal array of display pixels, such as electroluminescent devices, AC plasma panels, DC plasma panels and field emission displays and the like form a flat screen.

The basic structure of an AC Plasma Display Panel, or PDP, comprises two glass plates with a conductor pattern of electrodes on the inner surfaces of each plate. The plates are separated by a gas filled gap. The electrodes are configured in an x-y matrix with the electrodes on each plate deposited at right angles to each other using conventional thin or thick film techniques. At least one set of sustain electrodes of the AC PDP is covered with a thin glass dielectric layer. The glass plates are assembled into a sandwich with the gap between the plates fixed by spacers. The edges of the plates are sealed and the cavity between the plates is evacuated and filled with a mixture of neon and xenon gases or a similar gas mixture of a type well known in the art.

During operation of an AC PDP, a sufficient driver voltage pulse is applied to the electrodes to ionize the gas contained between the plates. When the gas ionizes, the dielectrics charge like small capacitors, which reduces the voltage across the gas and extinguishes the discharge. The capacitive voltages are due to charge stored and are conventionally called wall charge. The voltage is then reversed, and the sum of the driver voltage and wall charge voltages is again large enough to excite the gas and produce a glow discharge pulse. A sequence of such driver voltages repetitively applied is called the sustaining voltage, or sustainer. With the sustainer waveform pixels which have had charge stored will discharge and emit light pulses at every sustainer cycle. Pixels which have no charge stored will not emit light. As appropriate waveforms are applied across the x-y matrix of electrodes, small light emitting pixels form a visual picture.

Typically, layers of red, green or blue phosphor are alternately deposited upon the inner surface of one of the plates. The ionized gas causes the phosphor to emit a colored light from each pixel. Barrier ribs are typically disposed between the plates to prevent cross-color and cross-pixel interference between the electrodes. The barrier ribs also increase the resolution to provide a sharply defined picture. The barrier ribs further provide a uniform discharge space between the glass plates by utilizing the barrier rib height, width and pattern gap to achieve a desired pixel pitch.

Further details of the structure and operation of an AC PDP are disclosed in U.S. Pat. No. 5,723,945 titled "FLAT PANEL DISPLAY" and U.S. patent application Ser. No. 09/016,585, filed Jan. 30, 1998, entitled "DISPLAY PANEL HAVING MICROGROOVES AND METHOD OF OPERATION", both of which are incorporated herein by reference.

An object of this invention is to provide an improved structure for a flat-panel display, more particularly, an AC PDP which will increase the efficiency of the PDP by causing it to operate in a manner which more efficiently produces ultraviolet light to excite the phosphors. The present invention is an improved structure for a full color, high resolution capable flat-panel display which operates at a higher efficiency because of electrically isolated charge storage pads on the discharge surface.

SUMMARY OF THE INVENTION

The present invention contemplates a plasma flat-panel display comprising a first transparent substrate having a plurality of display electrodes deposited in parallel rows thereupon. In a preferred embodiment, the display electrodes are arranged in sustainer pairs. A layer of insulating film is deposited upon the surface of the first substrate covering the display electrodes. At least one electrically conductive surface pad is located upon the surface of the insulating film in association with a corresponding display electrode. An electron emissive surface coating covers at least a portion of the insulating film and may also coat the conducting surface pads.

The flat-panel display further includes a second substrate which is hermetically sealed to the first substrate. The second substrate has a plurality of micro-voids formed in a surface thereof which is adjacent to the first substrate. The micro-voids cooperate with the first substrate to define a plurality of sub-pixels which form rows parallel to the display electrodes and columns which are perpendicular to the display electrodes. The micro-voids are filled with an ionizable gas. A plurality of address electrodes are deposited upon the second substrate, each of the micro-voids correspond to an address electrode. A phosphor material is deposited within each micro-void and associated with the address electrodes.

The invention also contemplates that the display can include a pair of conductive surface pads located upon the surface of the first substrate insulating film in association with a corresponding pair of display electrodes. Each of the conductive surface pads being positioned to partially cover one of the display electrodes, thereby creating a capacitor. Further, the display can include a plurality of pairs of conductive surface pads located upon the surface of the first substrate insulating film, with each pair of conductive surface pads being associated with a corresponding pair of display electrodes.

The conductive surface pads can be formed from a metal, such as chromium, or a transparent conductive material, such as tin oxide or indium tin oxide.

The micro-voids can be formed by creating wells on the surface of the second substrate over and aligned with address electrodes. The un-voided surface areas form barrier ribs perpendicular to the display electrodes and divider ribs parallel to and separating pairs of display electrodes and conductive surface pads. Micro-voids can also be formed by etching microgrooves in the surface of the second substrate and depositing electrodes and phosphors therein by methods disclosed in U.S. Pat. No. 5,723,945, incorporated herein by reference. Alternately, parallel barrier ribs can be formed on the surface of the second substrate over and aligned with address electrodes to form the micro-voids as disclosed in U.S. Pat. No. 5,674,553, incorporated herein by reference.

BRIEF DESCRIPTION OF THE DRAWINGS

Further features and other objects and advantages of this invention will become apparent to those skilled in the art from the following detailed description of the preferred embodiment made with reference to the drawings in which:

FIG. 1 is a perspective view of a plasma display panel in accordance with the invention;

FIG. 2 is a perspective view of the second substrate of the plasma display panel shown in FIG. 1;

FIG. 3 is sectional view of the plasma display panel in FIG. 1 taken along line 2—2;

FIG. 4 is a plan view of the plasma display panel in FIG. 1 taken along the line 3—3;

FIG. 5 is a perspective view of the first substrate of the plasma display panel shown in FIG. 1;

FIG. 6 is a perspective view of the first substrate of the plasma display panel shown in FIG. 1 which includes an alternate embodiment of the charge storage pads;

FIG. 7 is a perspective view of an alternate embodiment of the plasma display panel shown in FIG. 1 which has a Metal On Groove (MOG) technology;

FIG. 8 is a perspective view of the second substrate of the plasma display panel shown in FIG. 7;

FIG. 9 is a perspective view of an alternate embodiment of the second substrate of the plasma display panel shown in FIG. 1 having ribs to form elongated voids;

FIG. 10 is a perspective view of an assembled plasma display panel which includes the second substrate shown in FIG. 9; and FIG. 11 is a graph which illustrates the operation of the charge storage pads shown in FIG. 1; and FIG. 12 is a sectional view illustrating an alternate embodiment taken from the same viewpoint as FIG. 3.

DETAILED DESCRIPTION OF THE PREFERRED EMBODIMENTS

Referring now to the drawings, there is illustrated in FIGS. 1–4 the structure of an improved plasma display panel (PDP), which, in the preferred embodiment, is an AC PDP. In the following description, like reference characters designate like or corresponding parts. Also, in the following description, it is to understood that such terms as "top", "bottom", "forward", "rearward", and similar terms of position and direction are used in reference to the drawings and for convenience in description.

The PDP includes a first substrate 6 with upper and lower surfaces as shown in FIG. 1. In a preferred embodiment, the first substrate 6 is formed from standard window glass, a glass which may contain $SiO_2$, $Al_2O_3$, $MgO_2$ and CaO as the main ingredients and $Na_2O$, $K_2O$, PbO, $B_2O_3$ and the like as accessory ingredients. A plurality of parallel paired display electrodes 7 are deposited upon the lower surface of the first substrate 6. As shown in FIG. 1, the display electrodes 7 are combined with transparent extensions 8; however, the extensions 8 are optional. Alternatively, the display electrodes may be patterned as a mesh to achieve transparency. Commonly, such electrodes may be made of gold with an adhesion layer of chrome or tantalum or of a chrome-copper-chrome sandwich. Transparent extensions are commonly made of indium-tin-oxide (ITO) alloy combination and may also be patterned with holes or openings as in FIG. 1 to reduce capacitance. As shown in FIG. 12, in an alternate embodiment, an optional layer of dielectric 13 may be applied and covers display electrodes 7 and 8, and an additional set of display electrodes 14 may be formed on its surface parallel to and cooperating with the first set of display electrodes 7 and 8. A layer of dielectric material 9 which has a electron-emissive layer 10 applied and covers the display electrodes 7 and extensions 8, and optional display electrodes 14 on dielectric layer 13. The dielectric materials are typically a lead based frit glass and are well known in the art. The photo-emissive layer is typically MgO or lead oxide. As shown in FIGS. 1 and 3, a plurality of conductive charge storage pads 11 are disposed upon the lower surface of the dielectric layer 9.

The first substrate 6 is hermetically sealed to a second substrate 1 which, in the preferred embodiment, also is formed from glass. A plurality of parallel address electrodes 2 which are perpendicular to the display electrodes 7 are deposited upon the upper surface of the second substrate 1. A layer of dielectric material 3 is deposited over the upper surface of the second substrate 1. The dielectric layer 3 covers the address electrodes 2. A plurality of barrier ribs 4 which are parallel to the address electrodes 2 and divider ribs 12 which are perpendicular to the address electrodes 2 extend upwardly from the upper surface of the dielectric layer 3. The barrier ribs 4 with divider ribs 12 space the second substrate 1 from the first substrate 6 and thereby define a plurality of wells. The wells are filled with a suitable ionizable gas mixture which, preferrably includes about 2–20 wt % xenon, most preferably 4–10 wt % xenon and, optionally 4–10 wt % helium and the remainder neon.

Phosphorus material 5 is deposited over the dielectric layer 3 between the barrier ribs 4 and divider ribs 12 and on all rib walls within the well. Thus, the phosphors are arranged upon the lower substrate 1 facing the pairs of display electrodes 7. The wells define a discharge space between the phosphor 5 and the display electrodes 7. During operation of the PDP, selected pairs of display electrodes 7 are energized to initiate a surface discharge between them which converts to a lateral discharge terminating at the facing ends of the conductive storage pads, see 20 in FIGS. 3 and 12.

For highest efficiency, the power into the surface discharge should be minimized compared to the power into the lateral discharge. The surface and lateral discharges emit ultra-violet rays which excite the adjacent phosphor 5. The excited phosphor 5 then emits light having a color corresponding to the phosphor color. As best seen in FIG. 4, each adjacent luminescent area may contain a different phosphor color, for example, red [R], green [G], and blue [B] phosphors arranged in a repetitive pattern as well known in the art. An image element is typically defined by three adjacent luminescent areas 5 corresponding to the above three colors.

In a preferred embodiment, the Charge Storage Pads (CSP) 11 consist of small rectangles of ITO as illustrated in the lower portion of FIG. 4 and in FIG. 5. The CSP's 11 are deposited upon the lower surface of the first substrate 6 by a conventional method, such as thin film deposition, E-beam deposition and the like, or as well known in the art, through a mask or as a continuous film which is patterned by photo-resist and etching techniques. In a preferred embodiment, ITO is used to form the CSP's 11, however, other materials, such as, for example, tin oxide or thin layers of chrome, gold, or tantalum also can be used to form the CSP's 11.

The CSP 11 is sized to correspond to the highest efficiency for a given pixel size of the PDP which allows addressing without cross-talk and is a portion of the display electrode width. Accordingly, the width of the CSP 11 can vary from about 100–400 microns, with a length of approximately 50 microns to nearly the barrier rib pitch and is typically a thickness of about 50–120 nanometers. As shown in FIG. 3, the CSP's 11 extend from beneath the outer edge of a first associated display electrode 7 of an associated display electrode pair and inward toward the other display electrode 7 forming the display electrode pair.

As shown in FIGS. 4 and 5, the individual CSP's 11 are separated by a gap, which is approximately 700 nanometers wide. As best seen in FIG. 4 and FIG. 5, in the preferred embodiment, at least one CSP 11 is included between the barrier ribs 4 for each of the display electrodes 7. The typical dimensions shown in FIG. 4 are for a 42 inch diagonal with VGA resolution, which is a matrix of 640 wide by 480 high white pixels which is at a white pixel pitch of 1260 microns. Displays with a white pixel pitch as high as 352 microns or 72 pixels per inch may also be made.

It will be appreciated, however, that the invention can be practiced with a plurality of CSP's 11 included between the barrier ribs. Because the CSP's 11 are separated by gaps, alignment of the first and second substrates, 6 and 1, is not required if there are three or more CSP's per barrier rib pitch. In that case, the size of each individual CSP 11 is small enough that if a portion of a CSP 11 extends past a barrier rib 4 into an adjacent channel, operation of the PDP is not adversely effected. Such an alternate embodiment of the CSP's 11 is illustrated in FIG. 6, and also in this case the extentions 8 are shown to be not patterned.

While the preferred embodiment of the CSP's 11 has been described and illustrated with rectangular shaped pads, it will be appreciated that the invention also can be practiced using other shapes for the pads. For example, the pads also can have trapezoidal, semi-circular, triangular, semi-elliptical or other shapes. Additionally, while CSP's 11 have been shown corresponding to each of the display electrodes 7 in a pair of electrodes, it also will be appreciated that the invention can be practiced with CSP's 11 provided for only one of the display electrodes 7 in a pair of electrodes.

An alternate embodiment of the second substrate is illustrated in FIG. 7 where a plurality of parallel microgrooves and barrier ribs are etched into the upper surface of the second substrate 1. In a preferred embodiment, a glass-ceramic composite doped with suitable nucleating agents is used to form the second substrate 1. The interior surfaces of the microgrooves is covered by the address electrodes 2. The address electrodes extend at least partially up the sides of the barrier ribs 4. The phosphor material 5 is deposited on and coincident with the address electrodes 2. The resulting structure is referred to as Metal On Groove (MOG) geometry, as described in U.S. Pat. No. 5,723,945, incorporated herein by reference above. Such microgrooves may have a rectangular shape; however, as shown in FIG. 8, the microgrooves also can be formed having a semi-circular shape. Other shapes can alternately be used for the microgrooves as explained and illustrated in the above referenced U.S. patent. The present invention contemplates that a second substrate having MOG geometry can be combined with a first substrate 6 having either embodiment of CSP's 11 described above to form an AC PDP. In FIG. 7, the second substrate having MOG geometry is combined with a modified first substrate combination shown in FIGS. 5 and 6.

Another alternate embodiment for the second substrate is illustrated generally in FIG. 9. The second substrate 30 includes a plurality of barrier ribs 4 formed on top of address electrodes 2 and dielectric layer 3. The present invention contemplates that the second substrate 1 having barrier ribs forming grooves as voids can be combined with a first substrate 6 having either embodiment of CSP's 11 described above to form an AC PDP. In FIG. 10, the second substrate 1 having electrodes under ribs and grooves is combined with the first substrate shown in FIG. 1 with the alternate narrower CSP's 11 illustrated in FIG. 6.

The inclusion of CSP's 11 enhances the efficiency of the PDP. The operation of the PDP with CSP's will now be explained with reference to FIG. 11. It is known that an increase in effective gap length and a higher xenon content in the fill gas increases the efficiency of a PDP discharge. The data lines which correspond to sim xx%Xe are from theoretical computer simulations of a one dimensional discharge of a PDP with the percentage of xenon contained in the filler gas varied. The computer simulation model is a fluid simulation of gaseous discharge based on a Neon/Xeon mixture using a repetitive sustaining voltage pulse. The simulation model is similar to that published by Boeuf, J. P. and Company (e.g. Journal Applied Physics, "A Simulation of an AC Plasma Discharge" Vol 78, 1995 p. 731) and computer code is available from Beouf to run simulations. The data is plotted as ultra-violet efficiency along the right vertical axis and a corresponding lumens per watt efficiency along the left vertical axis. The horizontal axis corresponds to the gap between CSP in microns. An actual measured data point for a PDP with lateral discharge is shown by the square labeled 38 located near the two lumens per watt line. However, the data taken at this point required a gap voltage in excess of 400 volts, which is believed impractical for commercial use since the corresponding address voltages would be too high, for example, in excess of about 200 volts.

In order to lower the gap voltage, a surface discharge is commonly used. This type of discharge typically has an efficiency of 0.8 lumens/watt in a commercially available PDP. A surface discharge is initiated in a low gap region, which is along the surface of the first substrate, where the display electrodes are the closest. The discharge then progresses outward along wide, typically transparent electrodes toward the higher gap regions. The efficiency of a typical surface discharge PDP is illustrated by the fine dotted line labeled 40 in FIG. 11. A further degradation in efficiency occurs because a charge is injected below the normal sustaining voltage for a given gap. The degraded efficiency is illustrated by the line labeled 42 in FIG. 11. An actual data point for such a commercial device is included in FIG. 11 as the square labeled 44.

The inclusion of CSP's in a PDP increases the amount of charge available for establishing the discharge. The CSP's cooperate with the display electrodes to form a plurality of small capacitors which store charge. Thus, for a given gap size, a larger percentage of the discharging current and power comes from the longer gap region defined by the ends of the two CSP's associated with the pair of display electrodes being energized. The efficiency of the PDP is proportionally improved. This is illustrated by the heavy line labeled 46 in FIG. 11. Three data points measured from experimental PDP's which include CSP's are included in FIG. 11 as circles with x's. A line connecting these data points is labeled 48 and correlates with the theoretical line 46. As can be seen the theoretical line 46 for a PDP with CSP's is higher that the theoretical line 42 for a PDP without CSP's. Similarly, the data points for PDP with CPS's fall above the data point for a PDP without CPS's. Also shown in FIG. 11 is a theoretical curve 50 for a PDP with CPS's which corresponds to curve 46 for a PDP without CPS's. Again, the inclusion of CPS's increases the efficiency of the PDP.

The efficiency may be further improved by any structure modification which decreases the amount of charge in the short-gap region. Such a modification is illustrated in FIG. 12. An additional layer of dielectric 13 is formed between the first substrate 6 and standard dielectric layer 9 with auxiliary sustain electrodes 14 formed upon its surface. These electrodes may be terminated commonly with display electrodes 7 and 8. Ideally, dielectric layer 13 should have a dielectric constant below that of dielectric layer 9 as much as practical. In this way, wall charge collected during the less efficient surface discharge phase is less, and the efficiency will be greater.

Additionally, the CSP's provide a degree of self-shielding from neighboring cells which reduces cross-talk between the cells. The effective gap can therefore be made greater than the gap in current commercially available PDP's. The addition of a horizontal, or divider, barrier rib 32, as illustrated in FIG. 9, forms wells which contain the discharge further reducing cross-talk. Practical PDP devices may be constructed with CPS's having efficiencies of up to 1.6 lumens/watt, or nearly twice the efficiency of heretofore known commercially available PDP's.

The patents and documents referenced herein are hereby incorporated by reference.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A matrix addressable plasma flat-panel display comprising:

a first transparent substrate;

a plurality of linear display electrodes deposited in parallel rows across a surface of said first substrate;

a dielectric layer of insulating film deposited upon said surface of said first substrate, said insulating film covering said display electrodes;

at least one electrically conductive surface pad located upon the surface of said dielectric layer of insulating film in association with a corresponding display electrode, said conductive surface pad covering only a portion of said corresponding display electrode and cooperating with said display electrode to form a capacitor, said capacitor operative to store electrical charge whereby the efficiency of the plasma flat-panel display is improved;

an electron emissive surface coating covering at least a portion of said insulating film and said display electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels which form rows parallel to said display electrodes and columns which are perpendicular to said display electrodes;

a gas filling said micro-voids;

a plurality of address electrodes incorporated within said second substrate, each of said address electrodes corresponding to one column of said sub-pixels; and a phosphor material deposited within each micro-void and associated with said address electrodes.

2. A plasma flat-panel display according to claim 1 further including a pair of conductive surface pads located upon the surface of said first substrate insulating film in association with a corresponding pair of display electrodes, each of said conductive surface pads being positioned to cover at least a portion of the width of one of said display electrodes.

3. A plasma flat-panel display according to claim 2 further including a plurality of pairs of conductive surface pads located upon the surface of said first substrate insulating film, each pair of conductive surface pads being associated with a corresponding pair of display electrodes.

4. A plasma flat-panel display according to claim 3 wherein said conductive surface pads are formed from a metal.

5. A plasma flat-panel display according to claim 4 wherein said conductive surface pads include chromium.

6. A plasma flat-panel display according to claim 5 wherein said conductive surface pads have a width which is within the range of 100 to 400 microns.

7. A plasma flat-panel display according to claim 3 wherein said conductive surface pads are formed from a transparent conductive material.

8. A plasma flat-panel display according to claim 7 wherein said conductive surface pads have a width which is within the range of 100 to 400 microns.

9. A plasma flat-panel display according to claim 7 wherein said conductive surface pads include tin oxide.

10. A plasma flat-panel display according to claim 7 wherein said conductive surface pads include indium tin oxide.

11. A plasma flat-panel display according to claim 3 further including a plurality of said conductive surface pads associated with each of said display electrodes, each of said conductive surface pads being associated with and located adjacent to a corresponding micro-void formed in said second substrate.

12. A plasma flat-panel display according to claim 3 further including a plurality of said conductive surface pads associated with each of said display electrodes, a plurality of said conductive surface pads being associated with and located adjacent to a corresponding micro-void formned in said second substrate.

13. A plasma flat-panel display according to claim 3 wherein the display is an AC plasma flat-panel display.

14. A plasma flat-panel display according to claim 3 wherein said micro-void are microgrooves formed in the surface of said second substrate, said microgrooves defining barrier ribs in the surface of said second substrate and further wherein said address electrodes are deposited across the bottom of said microgrooves and extend onto at least a portion of said barrier ribs.

15. A plasma flat-panel display according to claim 14 wherein said barrier ribs extend between and separate said conductive surface pads.

16. A plasma flat-panel display according to claim 3 further including a layer of material deposited upon said second substrate, said layer of material covering said address electrodes and having a plurality of parallel barrier ribs formed therein, said barrier ribs defining said micro-voids.

17. A plasma flat-panel display according to claim 16 wherein said barrier ribs extend between and separate said conductive surface pads.

18. A plasma flat-panel display according to claim 3 wherein a plurality of parallel barrier ribs are formed in the surface of said second substrate, and further wherein a plurality of divider ribs are formed in the surface of said second substrate, said divider ribs being perpendicular to said barrier ribs, said divider ribs cooperating with said barrier ribs to define said micro-voids, and said divider ribs extend between and separate said pairs of conductive surface pads.

19. A plasma flat-panel display according to claim 18 wherein said barrier ribs extend between and separate said conductive surface pads.

20. A matrix addressable plasma flat-panel display according to claim 1 wherein the electron emissive film is adjacent to and covers said conductive surface pads.

21. A matrix addressable plasma flat-panel display comprising:

a first transparent substrate;

a first plurality of linear display electrodes deposited in parallel rows across a surface of said first substrate;

a layer of insulating film deposited upon said surface of said first substrate, said insulating film covering said first plurality of display electrodes;

a second plurality of linear display electrodes deposited in parallel rows across said first layer of insulating film opposite from and in cooperation with said first plurality of display electrodes;

a second layer of insulating film deposited upon said surface of said first layer of insulating film and covering said second plurality of display electrodes;

at least one electrically conductive surface pad located upon a surface of said second layer of insulating film opposite from and in association with a corresponding second display electrode, said conductive surface pad cooperating with said second display electrode to form a capacitor, said capacitor operative to store electrical charge whereby the efficiency of the plasma flat-panel display is improved;

an electron emissive surface coating covering at least a portion of said insulating film and said second plurality of display electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels which form rows parallel to said display electrodes and columns which are perpendicular to said display electrodes;

a gas filling said micro-voids;

a plurality of address electrodes incorporated within said second substrate, each of said address electrodes corresponding to one column of said sub-pixels; and a phosphor material deposited within each micro-void and associated with said address electrodes.

22. A matrix addressable plasma flat-panel display according to claim 1 wherein the electron emissive film covers and is in contact with said conductive surface pads.

23. A plasma flat-panel display according to claim 22 where the electron emissive film is MgO in the thickness range of 100 to 800 nanometers.

24. A matrix addressable plasma flat-panel display comprising:

a first transparent substrate;

a first plurality of linear display electrodes deposited in parallel rows across a surface of said first substrate;

a first dielectric layer of insulating film deposited upon said surface of said first substrate, said insulating film covering said first plurality of display electrodes;

a second plurality of linear display electrodes deposited in parallel rows across said first layer of insulating film opposite from and corresponding to said first plurality of display electrodes, each of said second linear display electrodes covering only a portion of one of said corresponding first display electrodes;

a second dielectric layer of insulating film deposited upon said first dielectric layer of insulating film and covering said second plurality of display electrodes;

at least one electrically conductive surface pad located upon a surface of said second dielectric layer of insulating film opposite from and corresponding to a second display electrode, said conductive surface pad also covering only a portion of said first display electrode corresponding to said second display electrode, said conductive surface pad cooperating with both of said first and second corresponding display electrodes to form a capacitor, said capacitor operative to store electrical charge whereby the efficiency of the plasma flat-panel display is improved;

an electron emissive surface coating covering at least a portion of said second insulating film and said second plurality of display electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels which form rows parallel to said first display electrodes and columns which are perpendicular to said first display electrodes;

a gas filling said micro-voids;

a plurality of address electrodes incorporated within said second substrate, each of said address electrodes corresponding to one column of said sub-pixels; and a phosphor material deposited within each micro-void and associated with said address electrodes.

25. A plasma flat-panel display according to claim 24 further including a pair of conductive surface pads located upon the surface of said second insulating film, each of said conductive surface pads being of substantially the same width of said second plurality of display electrodes and positioned to cover at least a portion of the combined width of said first and second corresponding display electrodes.

26. A plasma flat-panel display according to claim 25 further including a plurality of pairs of conductive surface pads located upon the surface of said second insulating film, each pair of conductive surface pads being associated with a corresponding pair of first and second display electrodes.

27. A plasma flat-panel display according to claim 26 wherein said conductive surface pads are formed from a metal.

28. A plasma flat-panel display according to claim 27 wherein said conductive surface pads include chromium.

29. A plasma flat-panel display according to claim 28 wherein said conductive surface pads have a width which is within the range of 100 to 400 microns.

30. A plasma flat-panel display according to claim 26 wherein said conductive surface pads are formed from a transparent conductive material.

31. A plasma flat-panel display according to claim 30 wherein said conductive surface pads have a width which is within the range of 100 to 400 microns.

32. A plasma flat-panel display according to claim 30 wherein said conductive surface pads include tin oxide.

33. A plasma flat-panel display according to claim 30 wherein said conductive surface pads include indium tin oxide.

34. A plasma flat-panel display according to claim 26 further including a plurality of said conductive surface pads associated with each one of said display electrodes, each of said conductive surface pads being associated with and located adjacent to a corresponding micro-void formed in said second substrate.

35. A plasma flat-panel display according to claim 26 wherein the display is an AC plasma flat-panel display.

36. A plasma flat-panel display according to claim 26 wherein said micro-void are microgrooves formed in the surface of said second substrate, said microgrooves defining barrier ribs in the surface of said second substrate and further wherein said address electrodes are deposited across the bottom of said microgrooves and extend onto at least a portion of said barrier ribs.

37. A plasma flat-panel display according to claim 36 wherein said barrier ribs extend between and separate said conductive surface pads.

38. A plasma flat-panel display according to claim 26 further including a layer of material deposited upon said second substrate, said layer of material covering said address electrodes and having a plurality of parallel barrier ribs formed therein, said barrier ribs defining said micro-voids.

39. A plasma flat-panel display according to claim 38 wherein said barrier ribs extend between and separate said conductive surface pads.

40. A plasma flat-panel display according to claim 26 wherein a plurality of parallel barrier ribs are formed in the surface of said second substrate, and further wherein a plurality of divider ribs are formed in the surface of said second substrate, said divider ribs being perpendicular to said barrier ribs, said divider ribs cooperating with said barrier ribs to define said micro-voids, and said divider ribs extend between and separate said pairs of conductive surface pads.

41. A plasma flat-panel display according to claim 40 wherein said barrier ribs extend between and separate said conductive surface pads.

42. A plasma flat-panel display according to claim 24 wherein said electron emissive surface coating covers said electrically conductive surface pad.

43. A matrix addressable plasma flat-panel display comprising:

a first transparent substrate;

a plurality of linear display electrodes deposited in parallel rows across said first substrate;

a dielectric layer of insulating film deposited upon said surface of said first substrate, said insulating film covering said display electrodes;

a plurality of spaced apart electrically conductive surface pads located upon the surface of said dielectric layer of insulating film in association with and parallel to a corresponding display electrode, each of said conductive surface pads covering only a portion of said corresponding display electrode and cooperating with said display electrode to form a plurality of capacitors, each of said capacitors operative to store electrical charge whereby the efficiency of the plasma flat-panel display is improved;

an electron emissive surface coating covering at least a portion of said insulating film and said display electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels which form rows parallel to said display electrodes and columns which are perpendicular to said display electrodes;

a gas filling said micro-voids;

a plurality of address electrodes incorporated within said second substrate, each of said address electrodes corresponding to one column of said sub-pixels; and a phosphor material deposited within each micro-void and associated with said address electrodes.

44. A plasma flat-panel display according to claim 43 wherein each of said electrically conductive surface pads is adjacent to a corresponding micro-void formed in said second substrate.

45. A plasma flat-panel display according to claim 44 wherein said electron emissive surface coating covers said electrically conductive surface pads.

46. A matrix addressable plasma flat-panel display comprising:

a first transparent substrate;

a first plurality of linear display electrodes deposited in parallel rows across a surface of said first substrate;

a first dielectric layer of insulating film deposited upon said surface of said first substrate, said insulating film covering said first plurality of display electrodes;

a second plurality of linear display electrodes deposited in parallel rows across said first layer of insulating film opposite from and corresponding to said first plurality of display electrodes, each of said second linear display electrodes covering only a portion of one of said corresponding first display electrodes;

a second dielectric layer of insulating film deposited upon said first dielectric layer of insulating film and covering said second pluraity of display eletrodes;

a plurality of spaced apart electrically conductive surface pads located upon a surface of said dielectric layer of insulating film, said conductive surface pads being opposite from and parallel to a corresponding second display eletrode, each of said conductive surface pads covering only a portion of said first display eletrode corresponding to said second display eletrode, said conductive surface pads cooperating with both of said first and second corresponding display eletrodes to form a plurality of capacitors, each of said capacitors operative to store electrical charge whereby the efficiency of the plasma flat-panal display is improved;

an electron emissive surface coating covering at least a portion of said second insulating film and said second plurality of display electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels which form rows parallel to said display electrodes and columns which are perpendicular to said display electrodes;

a gas filling said micro-voids;

plurality of address electrodes incorporated within said second substrate, each of said address eletrodes corresponding to one cloumn of said sub-pixels; and a phosphor material deposited within each micro-void and associated with said address electrodes.

47. A plasma flat-panel display according to claim 46 wherein each of said electrically conductive surface pads is adjacent to a corresponding micro-void formed in said second substrate.

48. A plasma flat-panel display according to claim 47 wherein said electron emissive surface coating covers said electrically conductive surface pads.

* * * * *